US005649964A

United States Patent [19]

Berman et al.

[11] Patent Number: 5,649,964

[45] Date of Patent: Jul. 22, 1997

[54] VIBRATING TEETHING RING DEVICE

[76] Inventors: Paul Berman, 1133 N. Clark St. #203, Los Angeles, Calif. 90069; Cheryl Mansell, 7230 Mulholland Dr., Los Angeles, Calif. 90068; Darrell Greenland, 934 Fourth St. #21, Santa Monica, Calif. 90403

[21] Appl. No.: 502,816

[22] Filed: Jul. 14, 1995

[51] Int. Cl.[6] ..... A61J 17/00

[52] U.S. Cl. ..... 606/235; 601/139

[58] Field of Search ..... 446/3, 437; D24/194–200; 606/234–236; 601/40, 67, 80, 139–142

[56] References Cited

U.S. PATENT DOCUMENTS

D. 365,151 12/1995 Coppels et al. ..... D24/194

3,115,139 12/1963 Schneider ..... 606/235

5,284,490 2/1994 Green ..... 606/235

5,403,349 4/1995 Röhrig ..... 606/234

*Primary Examiner*—Glenn Dawson

[57] ABSTRACT

A teething ring device for massaging the gums of an infant. The inventive device includes an annular teething ring having a plurality of radial extension members projecting therefrom. A vibration handle is rotatably mounted to the teething ring for imparting vibrations thereto so as to massage the gums of a teething infant. The rotatable coupling of the teething ring to the vibration handle permits the ring to rotate relative to the handle in response to the vibration imparted thereto.

3 Claims, 4 Drawing Sheets

FIG 1
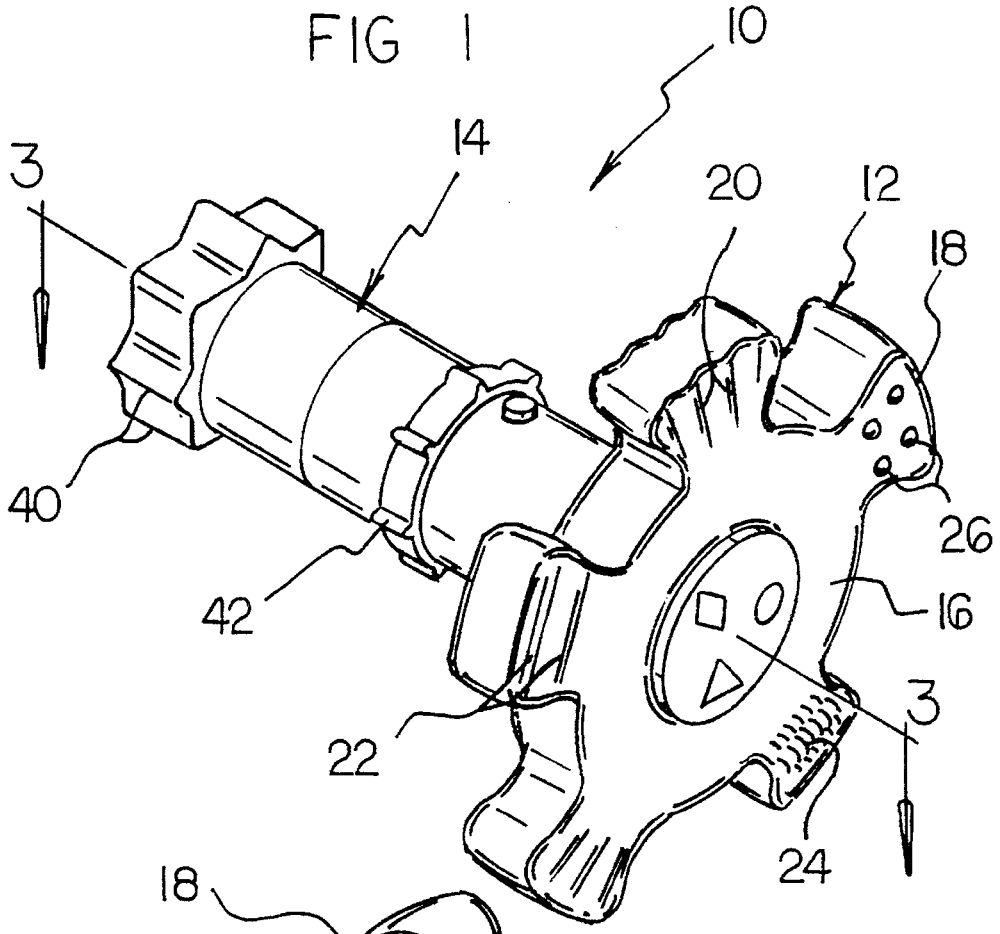
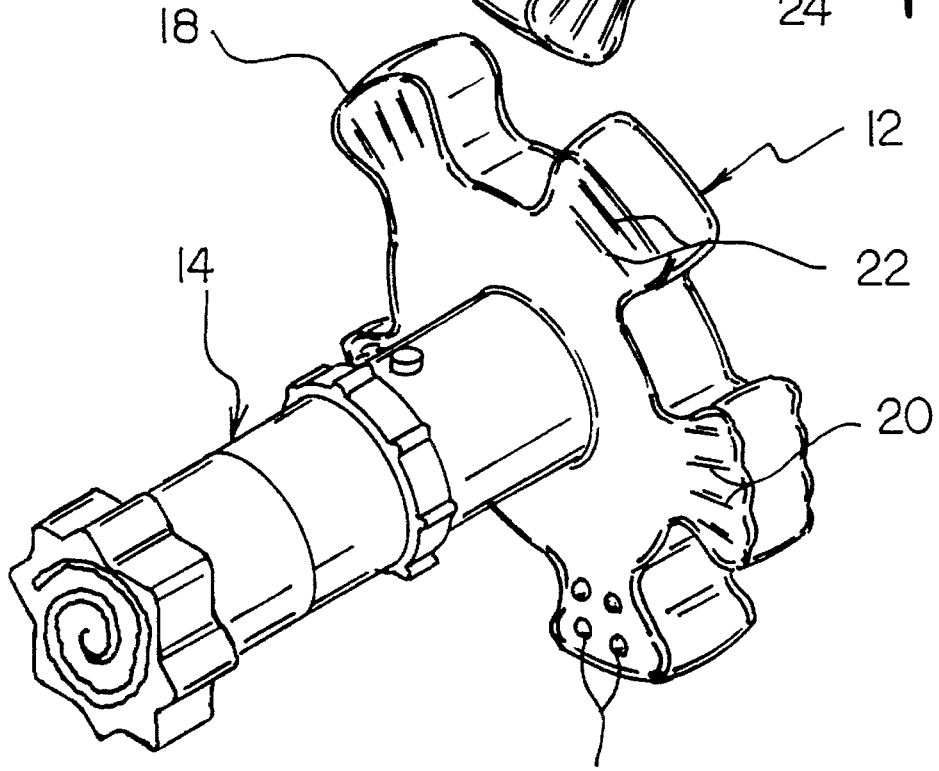
FIG 2

FIG 4
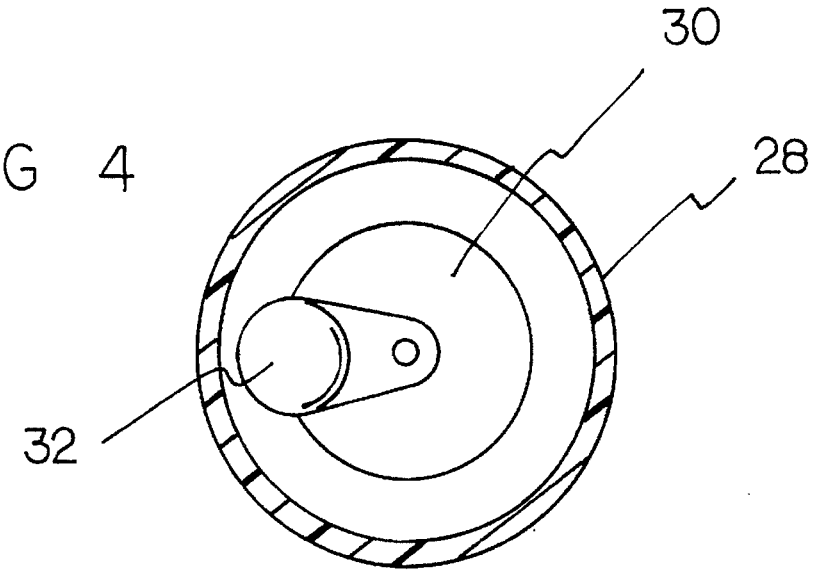
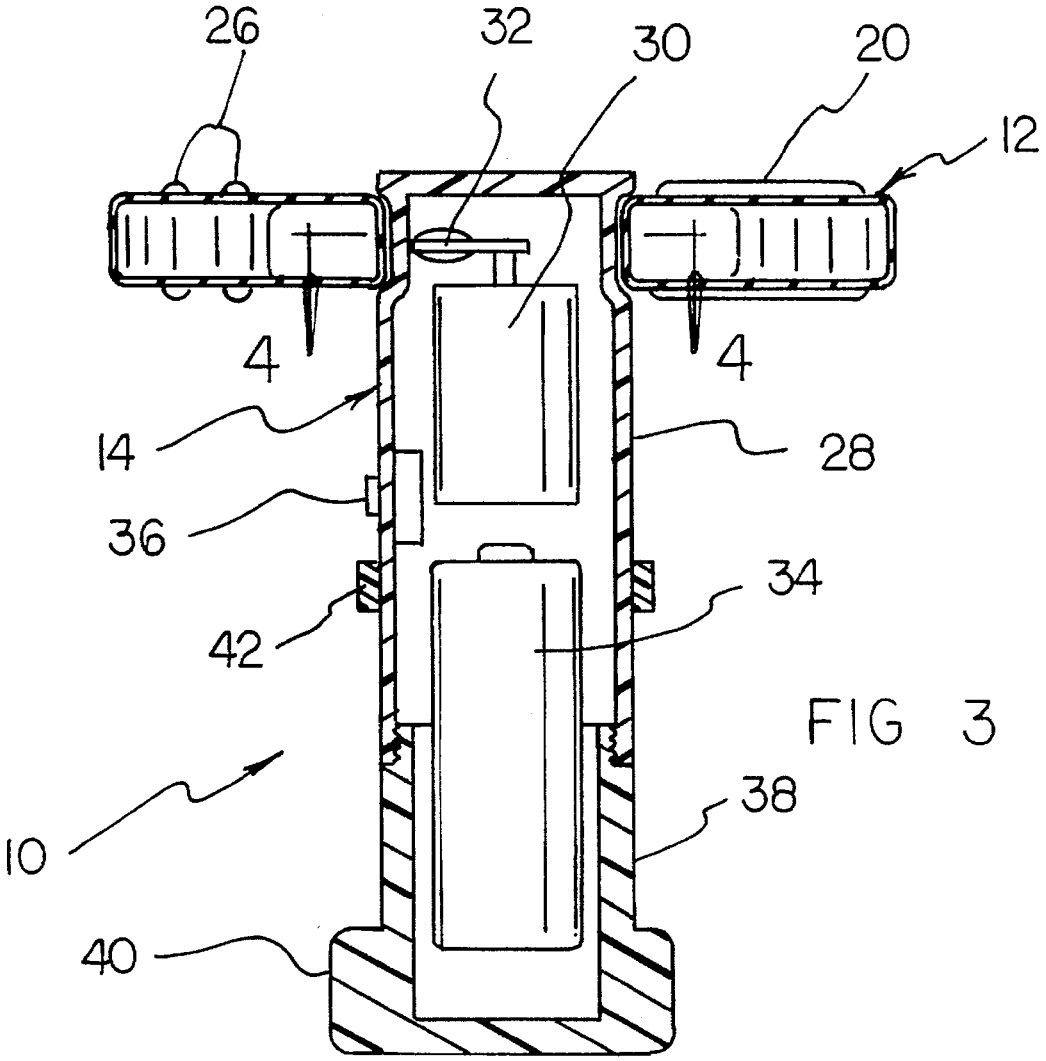
FIG 3

FIG 5
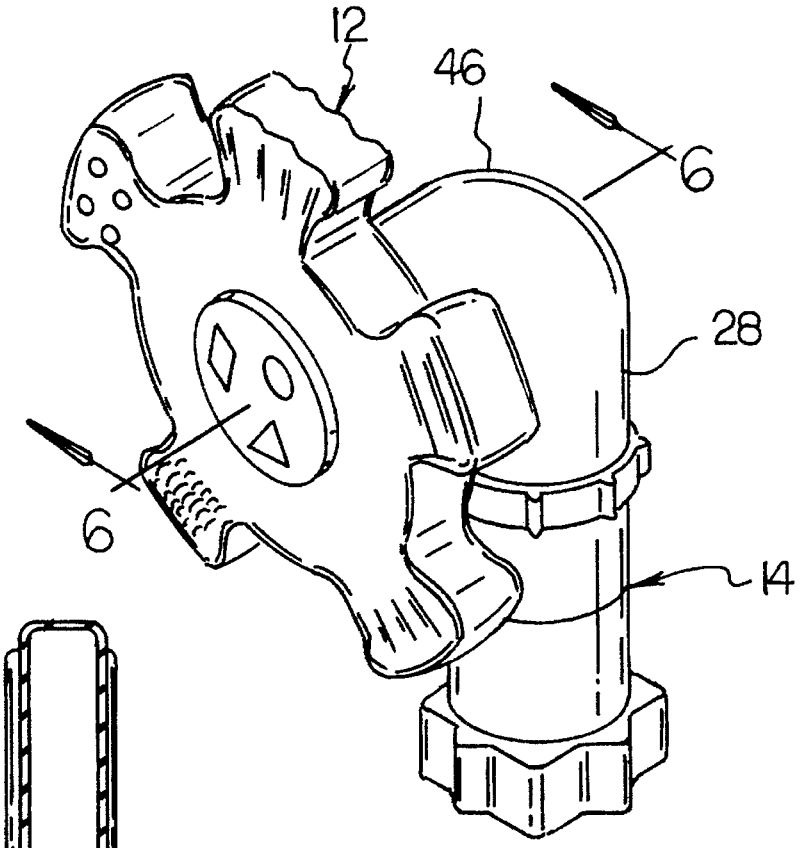
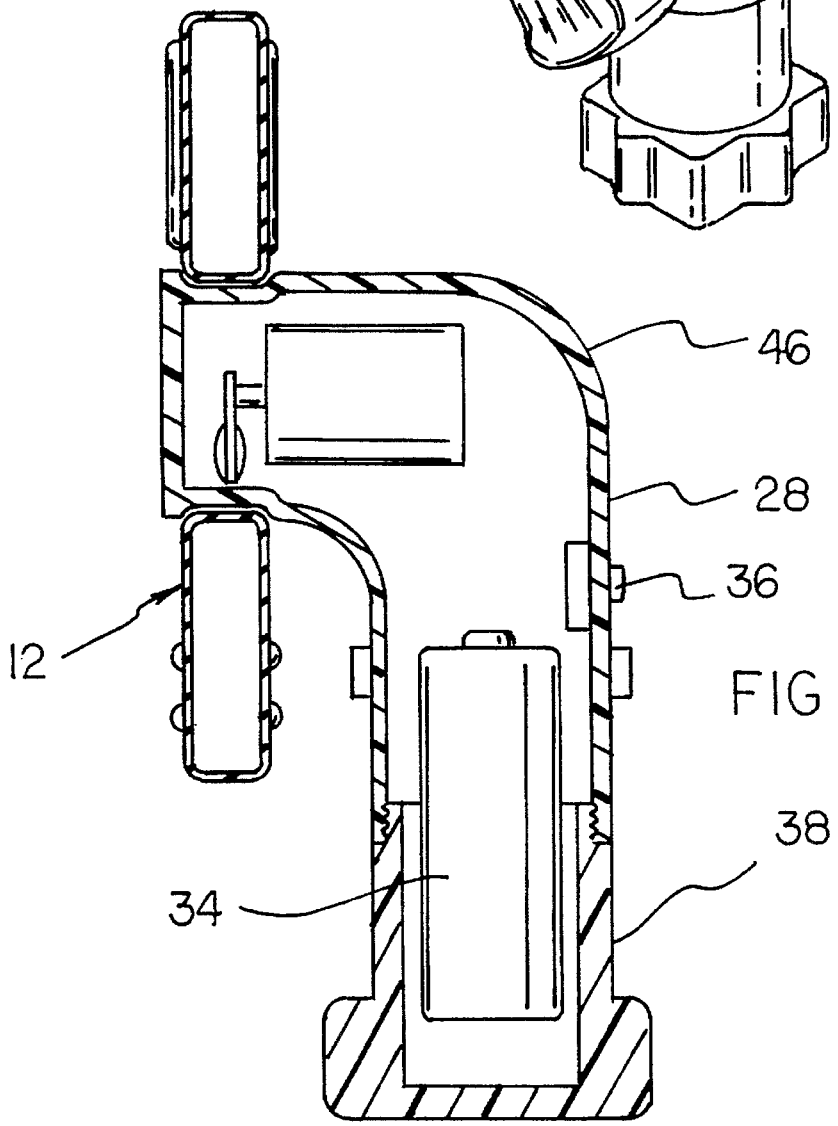
FIG 6

VIBRATING TEETHING RING DEVICE

BACKGROUND OF THE INVENTION

1. Field of the Invention

The present invention relates to infant teething structures and more particularly pertains to a vibrating teething ring device for massaging the gums of an infant.

2. Description of the Prior Art

The use of infant teething structures is known in the prior art. More specifically, infant teething structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art infant teething structures include U.S. Pat. No. 5,291,878; and U.S. Pat. No. 4,347,839.

While these devices fulfill their respective, particular objectives and requirements, the aforementioned patents do not disclose a vibrating teething ring device for massaging the gums of an infant which includes an annular teething ring having a plurality of radial extension members projecting therefrom, and a vibration handle rotatably mounted to the teething ring for imparting vibrations thereto so as to massage the gums of a teething infant, wherein the rotatable coupling of the teething ring to the vibration handle permits the ring to rotate relative to the handle in response to vibration imparted thereto.

In these respects, the vibrating teething ring device according to the present invention substantially departs from the conventional concepts and designs of the prior art, and in so doing provides an apparatus primarily developed for the purpose of massaging the gums of an infant.

SUMMARY OF THE INVENTION

In view of the foregoing disadvantages inherent in the known types of infant teething structures now present in the prior art, the present invention provides a new vibrating teething ring device construction wherein the same can be utilized for massaging the gums of an infant. As such, the general purpose of the present invention, which will be described subsequently in greater detail, is to provide a new vibrating teething ring device apparatus and method which has many of the advantages of the infant teething structures mentioned heretofore and many novel features that result in a vibrating teething ring device which is not anticipated, rendered obvious, suggested, or even implied by any of the prior art infant teething structures, either alone or in any combination thereof.

To attain this, the present invention generally comprises a teething ring device for massaging the gums of an infant. The inventive device includes an annular teething ring having a plurality of radial extension members projecting therefrom. A vibration handle is rotatably mounted to the teething ring for imparting vibrations thereto so as to massage the gums of a teething infant. The rotatable coupling of the teething ring to the vibration handle permits the ring to rotate relative to the handle in response to the vibration imparted thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vibrating teething ring device apparatus and method which has many of the advantages of the infant teething structures mentioned heretofore and many novel features that result in a vibrating teething ring device which is not anticipated, rendered obvious, suggested, or even implied by any of the prior art infant teething structures, either alone or in any combination thereof.

It is another object of the present invention to provide a new vibrating teething ring device which may be easily and efficiently manufactured and marketed.

It is a further object of the present invention to provide a new vibrating teething ring device which is of a durable and reliable construction.

An even further object of the present invention is to provide a new vibrating teething ring device which is susceptible of a low cost of manufacture with regard to both materials and labor, and which accordingly is then susceptible of low prices of sale to the consuming public, thereby making such vibrating teething ring devices economically available to the buying public.

Still yet another object of the present invention is to provide a new vibrating teething ring device which provides in the apparatuses and methods of the prior art some of the advantages thereof, while simultaneously overcoming some of the disadvantages normally associated therewith.

Still another object of the present invention is to provide a new vibrating teething ring device for massaging the gums of an infant.

Yet another object of the present invention is to provide a new vibrating teething ring device which includes an annular teething ring having a plurality of radial extension members projecting therefrom, and a vibration handle rotatably mounted to the teething ring for imparting vibrations thereto so as to massage the gums of a teething infant, wherein the rotatable coupling of the teething ring to the vibration handle permits the ring to rotate relative to the handle in response to vibration imparted thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front isometric illustration of a vibrating teething ring device according to the present invention.

FIG. 2 is a rear isometric illustration thereof.

FIG. 3 is a cross sectional view taken along line 3—3 of FIG. 1.

FIG. 4 is a cross sectional view taken along line 4—4 of FIG. 3.

FIG. 5 is an isometric illustration of an alternative form of the present invention.

FIG. 6 is a cross sectional view taken along line 6—6 of FIG. 5.

DESCRIPTION OF THE PREFERRED EMBODIMENT

Figure 7:
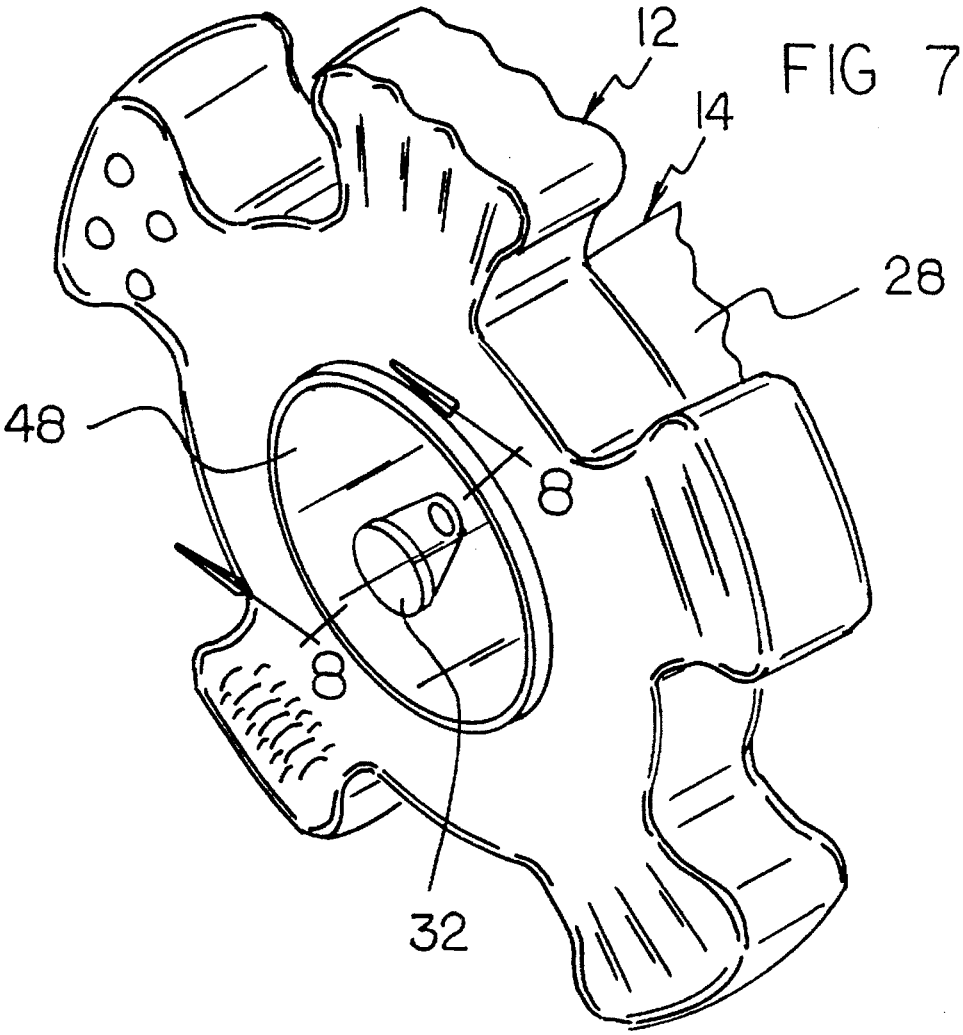
FIG. 7 is an enlarged isometric illustration of a portion of the invention including a transparent window.

With reference now to the drawings, and in particular to FIGS. 1–8 thereof, a new vibrating teething ring device embodying the principles and concepts of the present invention and generally designated by the reference numeral 10 will be described.

More specifically, it will be noted that the vibrating teething ring device 10 comprises a teething ring 12 of substantially annular configuration, as shown in FIG. 1 of the drawings. A vibration means 14 is rotatably coupled to the teething ring 12 for vibrating the teething ring to massage the gums of an infant utilizing the device 10. By this structure, the vibration means 14 not only imparts vibration to the teething ring 12, but causes the teething ring to rotate relative to the vibration means 14 during operation of the present invention 10.

As best illustrated in FIGS. 1 and 2 of the drawings, it can be shown that the teething ring 12 of the present invention 10 preferably comprises an annular member 16 formed of a substantially resilient material and including a plurality of radial extension members 18 projecting in a radially spaced orientation relative to one another from an outer surface of the annular member 16. As shown in FIG. 3, the teething ring 12 may be constructed in a substantially hollow configuration so as to be collapsible during use thereof. As shown in FIG. 1, each of the radial extension members 18 may be shaped so as to define a textured surface extending along exterior portions thereof. To this end, the textured surface may comprise a plurality of radial projections 20 extending in a radial orientation from the annular member 16, a plurality of transverse projections 22 extending substantially parallel to a tangent line of the annular member 16, a plurality of projecting ridges 24, or a plurality of hemispherical projections 26 extending from each of the radial extension members 18. By this structure, the textured surfaces of the radial extension members 18 serves to further enhance to massaging effect of the teething ring 12 against the gums of an infant utilizing the device 10.

Referring now to FIGS. 2 through 4 wherein the vibration means 14 is illustrated in detail, it can be shown that the vibration means 14 comprises a handle tube 28 having an upper end spaced from a lower end which is substantially hollow in configuration. A motor 30 is mounted within the handle tube 28 by unillustrated stanchions extending therebetween and includes an eccentric weight 32 mounted to a shaft of the motor. A battery 34 can be received within the handle tube 28 and electrically coupled to the motor 30 through a switch 36 and unillustrated wires which extend between the battery 34, the switch 36, and the motor 30. The switch 36 may comprise a manually operable switch including a projecting switch member, or alternatively may comprise a motion switch electrically coupled to a timer, wherein motion of the device 10 actuates the electric motor 30 for a predetermined length of time. The battery 34 is removably contained within the handle tube 28 by an end cap 38 which is removably coupled to a lower end of the handle tube 28. The end cap 38 may include conventionally known child-proof locking structure such as is commonly utilized with pill bottles and the like so as to preclude removal of the end cap 38 from the handle tube 28 by an infant. To facilitate manual manipulation of the vibration means 14 during use of the device 10 by an infant, the end cap 38 is preferably shaped so as to define a plurality of gripping projections 40 projecting radially therefrom. Further, a gripping ring 42 can be coupled to an exterior of the handle tube 28 so as to extend circumferentially about an exterior thereof and similarly includes a plurality of projections extending radially therefrom.

The handle tube 28 of the vibration means 14 is rotatably coupled to the teething ring 12 as shown in FIG. 3. To this end, an upper end of the handle tube 28 is shaped so as to define a circumferentially extending annular groove which projects through a center aperture of the annular member 16 of the teething ring 12. Preferably, an annular space is defined between an exterior surface of the annular groove of the handle tube 28 and an interior of surface of the center aperture of the annular member 16 of the teething ring 12 such that the teething ring 12 can freely rotate about the handle tube 28. By this structure, a rotation of the eccentric weight 32 by the motor 30 upon energization thereof will impart a vibrational motion to the handle tube 28 which is subsequently transferred to the teething ring 12 as the exterior surface of the annular groove of the handle tube impacts the interior surface of the center aperture of the annular member 16 of the teething ring 12. Such interaction between the handle tube 28 and the teething ring 12 will result in a vibration-induced rotation of the teething ring 12 analogous to the spinning of a hula-hoop member about a waist of an individual.

Referring now to FIGS. 5 and 6, it can be shown that the handle tube 28 of the present invention 10 may be shaped so as to define an orthogonal bend 42 which orients the upper end of the handle tube 28 at a substantially orthogonal orientation relative to the lower end thereof. As shown in FIG. 6, the motor 30 and the eccentric weight 32 coupled to the motor shaft thereof are mounted in the upper end of the handle tube 28 such that the eccentric weight 32 rotates within a plane bisecting the axial length of the center aperture of the annular member 16.

Figure 8:
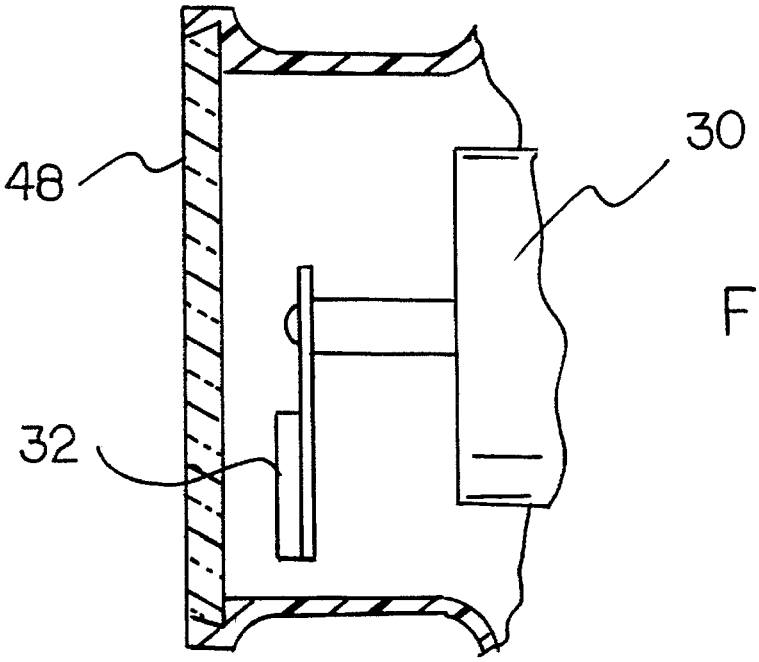
FIG. 8 is a cross sectional view taken along line 8—8 of FIG. 7.

Referring now to FIGS. 7 and 8, it can be shown that the present invention 10 may further comprise a transparent window 48 mounted to the upper end of the handle tube 28 of the vibration means 14. The transparent window 48 permits for viewing of the eccentric weight 32 therethrough for the entertainment of a child. To this end, the eccentric weight 32 may alternatively comprise an eccentrically weighted disk having a colored pattern or the like which further entertains a child viewing the same through the transparent window 48.

In use, the vibrating teething ring device 10 of the present invention can be easily utilized for massaging the gums of an infant as the infant bites the teething ring 12 thereof. The rotatable coupling of the teething ring 12 to the vibration means 14 not only permits for a vibration-induced rotation of the teething ring relative to the vibration means, but further permits for ease of separation of the teething ring 12 from the vibration means so as to permit storage and/or washing of the teething ring separate from the vibration means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vibrating teething ring device comprising:

a teething ring; and a vibration means rotatably coupled to the teething ring for vibrating the teething ring to massage the gums of an infant, the vibration means comprising a handle tube having an upper end spaced from a lower end, wherein the handle tube of the vibration means is rotatably coupled to the teething ring.

2. A teething ring device comprising:

a teething ring;

a vibration means rotatably coupled to the teething ring for vibrating the teething ring to massage the gums of an infant, wherein the vibration means comprises a handle tube having an upper end spaced from a lower end; a motor mounted within the handle tube and including a shaft with an eccentric weight mounted to the shaft of the motor; and a switch mounted to the vibration means and being positionable in electrical communication with a battery so as to permit selective energizing of the motor, the switch including a projecting switch member, wherein the handle tube of the vibration means is rotatably coupled to the teething ring;

an end cap removably coupled to the lower end of the handle tube, wherein the end cap is shaped so as to define a plurality of gripping protections projecting radially therefrom; and a gripping ring coupled to an exterior of the handle tube so as to extend circumferentially about an exterior thereof, the gripping ring including a plurality of protections extending radially therefrom.

3. A vibrating teething ring device comprising:

a teething ring; and a vibration means comprising a handle tube having an upper end spaced from a lower end, wherein the handle tube is rotatably mounted to said teething ring and is shaped so as to define an orthogonal bend which orients the upper end of the handle tube at a substantially orthogonal orientation relative to the lower end thereof.

* * * * *